United States Patent [19]

Bender et al.

[11] Patent Number: 4,660,473

[45] Date of Patent: Apr. 28, 1987

[54] COMPRESSED GAS-ACTUATED MECHANICAL POWER ELEMENT

[75] Inventors: Richard Bender, Lauf; Hellmut Bendler, Nuremberg; Gerrit Scheiderer; Hans Winkler, both of Fürth, all of Fed. Rep. of Germany

[73] Assignee: Dynamit Nobel Aktiengesellschaft, Troisdorf, Fed. Rep. of Germany

[21] Appl. No.: 683,681

[22] Filed: Dec. 19, 1984

[30] Foreign Application Priority Data

Dec. 30, 1983 [DE] Fed. Rep. of Germany ..... 3347553
Apr. 27, 1984 [DE] Fed. Rep. of Germany ..... 3415680

[51] Int. Cl.[4] ..... F42C 15/32
[52] U.S. Cl. ..... 102/223; 102/205
[58] Field of Search ..... 102/205, 223

[56] References Cited

U.S. PATENT DOCUMENTS

| | | | |
|---|---|---|---|
| 1,563,418 | 12/1925 | Adelman | 102/223 |
| 2,110,552 | 3/1938 | Hayden | 102/223 X |
| 3,478,760 | 11/1969 | Hosek et al. | 137/68 |
| 3,592,138 | 7/1971 | Broske | 102/28 R |
| 3,735,707 | 5/1973 | Unfried et al. | 102/224 |
| 3,771,551 | 11/1973 | John | 137/486 |
| 3,985,058 | 10/1976 | Corrado et al. | 102/205 X |
| 4,135,454 | 1/1979 | Morris et al. | 102/205 X |
| 4,311,097 | 1/1982 | Backstein et al. | 102/223 X |
| 4,487,126 | 12/1984 | Schaper | 102/223 X |

FOREIGN PATENT DOCUMENTS

| | | |
|---|---|---|
| 2654441 | 5/1978 | Fed. Rep. of Germany . |
| 1513588 | 6/1967 | France . |
| 470069 | 4/1969 | Switzerland . |

*Primary Examiner*—Peter A. Nelson
*Attorney, Agent, or Firm*—Antonelli, Terry & Wands

[57] ABSTRACT

Two cylinder chambers are provided in a housing, each of these chambers containing a piston. Pins project, as piston rods, from the pistons in differing directions. A duct is located in a zone between the pistons. This duct is in communication with a compressed gas cartridge. Upon triggering of the compressed gas cartridge, the released gas moves the pistons apart so that the pins are moved simultaneously or in accordance with a predetermined sequence of operations.

16 Claims, 7 Drawing Figures

COMPRESSED GAS-ACTUATED MECHANICAL POWER ELEMENT

The invention relates to a compressed gas-actuated mechanical power element or device with a housing containing a cylinder chamber, with a piston displaceable in the cylinder chamber carrying a pin projecting out of the housing, and with a compressed gas cartridge in communication with the cylinder chamber.

Power elements operated by compressed gas and retracting and/or extending a pin attached to a piston are conventional (DOS [German Unexamined Laid-Open Application] No. 2,253,657, German Patent No. 2,328,184). By ignition of a solid propellant composition contained in a compressed gas cartridge, a hot gas is generated which is conducted into the cylinder chamber and moves the piston with the pin attached thereto, this pin having the function of a piston rod. The use of these power elements is primarily encountered as a detonator component in the military sector, but also for civilian usages; e.g., as a switch for the transmission of signals or for unlocking purposes.

The conventional power elements can exert in each case merely a single function, in that they act, with their pin, retracted or extended in case of triggering, on an external component. If several functions must be carried out simultaneously, a corresponding number of power elements must be provided which are ignited simultaneously. The necessary expenditure of compressed gas-actuated power elements is thereby multiplied.

The invention is based on the object of constructing a compressed gas-actuated mechanical power element in such a way that it is capable, after triggering or actuation of the compressed gas cartridge, of performing several functions simultaneously.

In order to attain this object, the invention provides that the housing contains at least one second cylinder chamber with a second piston displaceable therein and having a pin projecting out of the housing; and that both cylinder chambers are in communication with each other and with the compressed gas cartridge common to both of them. The compressed gas may be, for example, produced by a pyrotechnic mixture, as described in U.S. Pat. No. 3,468,730. Fuerth, 7$^{th}$ of December 1984

According to the invention, the compressed gas cartridge exerts pressure simultaneously on two (or more) pistons so that both pistons are moved synchronously. The pins of the pistons, acting on the external elements, are retracted or optionally also extended simultaneously and with equal forces, so that it is ensured that the external elements are retracted and/or extended exactly at the same time and with mutually equal forces. It is also possible, by special structural measures, to cause a delay of one pin with respect to the other pin and, thus, to effect, with the same power element, two different operational steps with a defined, brief time interval. In each case, the two operating steps executed by the pins are in a predetermined relationship to each other, and both operating steps are effected by the same compressed gas cartridge, so that it cannot happen that on account of a malfunction only one of the pins is moved. Also, by means of different-sized piston surfaces, the forces transmitted via the pins can be different.

Preferably, the pins of the pistons extend in parallel to each other. This results in a small structural size of the housing wherein the cylinder chambers are arranged with parallel axes. However, it is also possible in principle to orient the cylinder chambers into differing directions so that, for example, the pins can be moved under an angle larger than zero. The power element of this invention can thus act in different directions and can be adapted to the respective constructional conditions, i.e., it can act simultaneously on elements which must be operated in differing directions. After production of the gas, the pins, by way of movement of the pistons, are retracted or expelled by a distance given by the volume of the respective cylinder chamber and/or its axial length. It is also possible to retract one pin and extend the other pin.

The cylinder chambers are in communication with the compressed gas cartridge preferably via at least one duct. This duct can also consist of a conduit so that it is not necessary to accommodate the compressed gas cartridge in the interior of the housing.

An especially compact size results if the compressed gas cartridge is arranged within one of the pistons.

In compressed gas-actuated mechanical power elements, the pins normally engage the piston in the center. In the dual-acting power element of this invention, the diameter of the housing can be reduced by arranging at least one of the pins eccentrically at the associated piston, and having this pin project through a bore of the other piston. As a result thereof, in case of a relatively large piston cross section, the pistons are moved along a combined axis and the pins (piston rods) are linearly guided through the, respectively, other piston or cylinder chamber. The forces acting on the pistons are correspondingly large on account of the large piston cross sections.

Embodiments of the invention will be described in greater detail below with reference to the drawings wherein:

FIG. 1 is a longitudinal section through a power element;

FIG. 1*a* is a cross section along line a—a of FIG. 1;

FIG. 2 is a longitudinal section through another embodiment of the power element;

FIG. 2*a* is a section along line a—a of FIG. 2;

Figure 1:
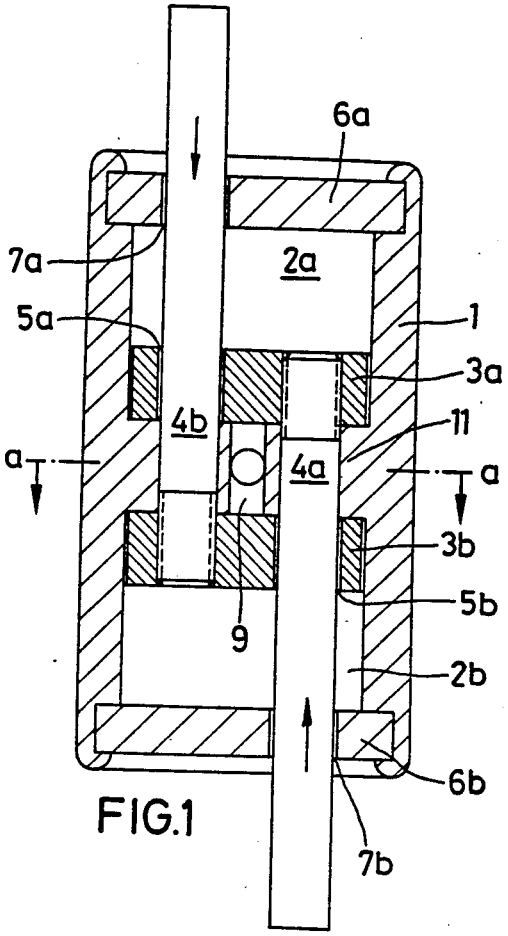
Figure 1A:
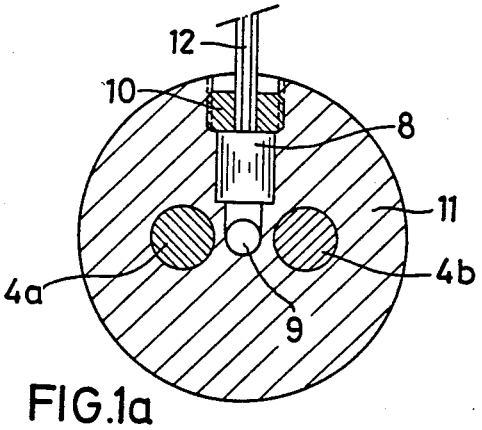

According to FIGS. 1 and 1*a*, two axially and series-arranged cylinders chambers 2*a*, 2*b* are provided in a housing 1 made of a metal, for example, a brass alloy or steel alloy, each of these chambers containing an axially displaceable piston 3*a*, 3*b*. Both cylinder chambers 2*a* and 2*b* are separated from each other by a transversely extending partition 11 of the housing 1. A piston rod in the form of a cylindrical pin 4*a*, 4*b* is attached to each of the pistons 3*a*, 3*b*. Each pin projects through a bore of the partition 11 and through a bore 5*a*, 5*b* of the opposite piston. The cylinder chambers 2*a*, 2*b* are delimited with respect to the outside faces of the housing 1 by means of a flanged-in end wall 6*a*, 6*b*. The pins 4*a*, 4*b* project from the housing 1 through bores 7*a*, 7*b* of the end walls 6*a*, 6*b*.

The compressed gas cartridge 8 is located in a transverse bore in the interior of the partition 11, this cartridge being aligned at a right angle to the longitudinal extension of the housing 1 and being retained in the latter by means of a screw bolt 10. Electric leads 12 extend from the compressed gas cartridge 8 out of the housing. Upon the application of an electrical voltage to the leads 12, the solid propellant in the compressed gas cartridge 8 is ignited. By the thus-occurring release of gas, the end wall of the compressed gas cartridge oriented toward the interior of the housing is burst open. Thereby, compressed gas enters the axial duct 9 passing through the partition 11, this duct terminating in the two cylinder chambers 2*a* and 2*b*. The pistons 3*a* and 3*b*, initially being in the retracted condition, i.e., in contact with the partition 11, are acted upon by the pressure of the compressed gas and driven outwardly in the cylinder chambers 2*a* and 2*b*. Thereby the two pins 4*a* and 4*b* are retracted into the housing 1 in the direction of the illustrated arrows. The retraction distances are limited by the lengths of the cylinder chambers 2*a* and 2*b*. Since the pressure buildup of the compressed gas takes place very quickly, sealing of the pistons in relation to the respective wall of the cylinder chamber is necessary only if large forces must be overcome during retraction of the pins.

Figure 2:
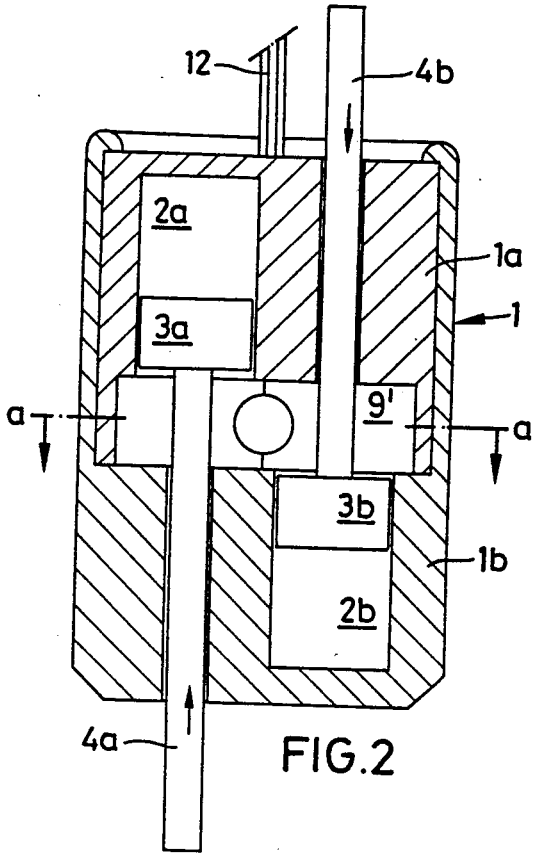
Figure 2A:
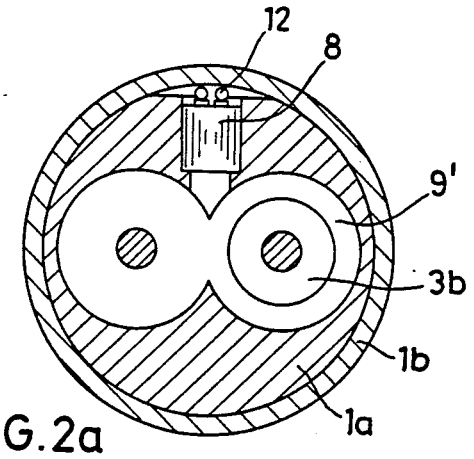

Whereas, in the embodiment of FIGS. 1 and 1*a*, both pins 4*a* and 4*b* engage eccentrically at the associated piston 3*a* and 3*b*, respectively, FIGS. 2 and 2*a* show an embodiment wherein the cylinder chambers 2*a* and 2*b* are offset axially and laterally with respect to each other. The housing 1 consists of two housing sections 1*a* and 1*b* put together, each containing a cylinder chamber 2*a*, 2*b*. The section 1*a* is inserted in a sleeve-like extension of section 1*b* and retained by flanging over of the extension. On the inner end wall of one housing section 1*a*, a recess 9' is provided into which terminate the two cylinder chambers 2*a* and 2*b*. The cylinder chambers are blind bores extending from the inner end wall of the respective housing section and running in opposite directions in the assembled condition of the housing 1. In each cylinder chamber 2*a*, 2*b*, a piston 3*a*, 3*b* is arranged at which the pin 4*a*, 4*b* engages centrally. Each pin is extended toward the outside through a longitudinal bore of the other housing section.

The compressed gas cartridge 8 is located in a transverse bore of the housing 1, terminating in the recess 9' connecting the cylinder chambers 2*a*, 2*b*. Upon ignition of the compressed gas cartridge 8, a pressure builds up in the recess 9', this pressure being transmitted to the pistons 3*a*, 3*b* and moving same outwardly in the cylinder chambers 2*a*, 2*b*.

In the embodiment of FIGS. 2 and 2*a*, both pins 4*a* and 4*b* are retracted into the housing upon triggering of the compressed gas cartridge 8. It is possible as an alternative for one of the pins (or both) not to extend through the recess 9' but rather to project from the housing toward the opposite side through a bore in the end wall of the respective cylinder chamber. In this case, the respective pin would be moved out of the housing 1 upon triggering of the compressed gas cartridge. Also, a combined arrangement is possible wherein one pin is retracted and the other pin is urged outwards.

Figure 3:
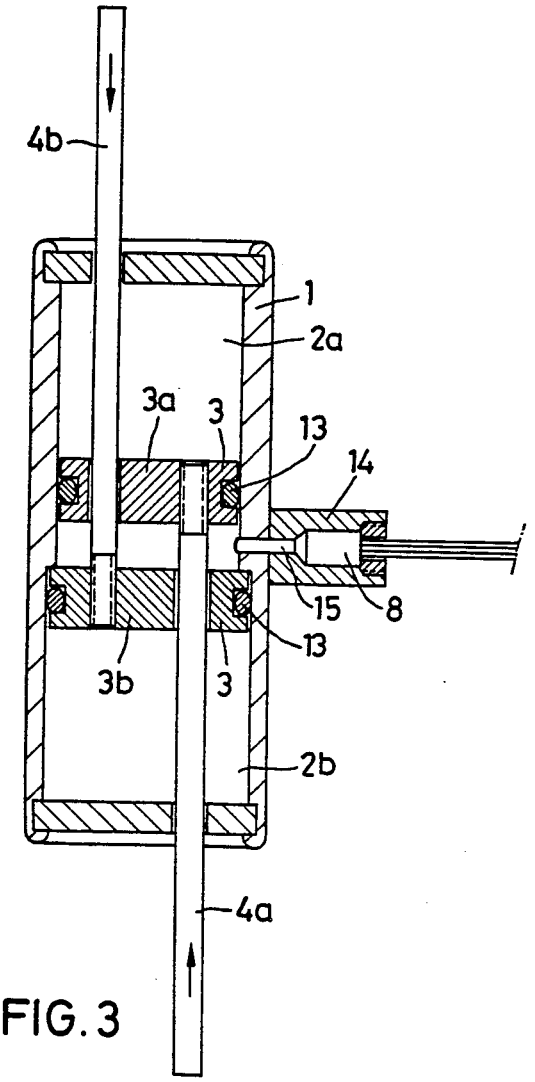
FIG. 3 is a longitudinal section through a third embodiment of the power element.

In the embodiment illustrated in FIG. 3, the cylinder chambers 2*a* and 2*b* are aligned axially with respect to each other without there being a partition between them. The pins 4*a*, 4*b* hwere again pass (as in fig. 1) through bores of the respectively other piston and each of the pins engages its associated piston eccentrically. Each piston 3*a*, 3*b* is provided with a sealing ring 13 to provide a seal with respect to the wall of the associated cylinder chamber 2*a*, 2*b*. The compressed gas cartridge 8 is arranged in a housing extension 14 laterally projecting from the housing 1, a duct 15 extending from this extension and terminating in the zone between the pistons 3*a*, 3*b*.

Figure 4:
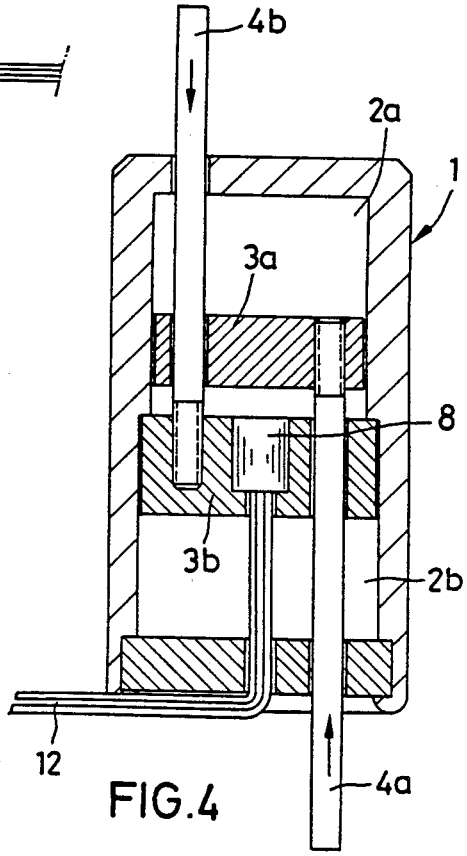
FIG. 4 is a longitudinal section through a fourth embodiment of the power element.

In the embodiment of FIG. 4, the compressed gas cartridge 8 is disposed in a bore in the interior of one piston 3*b*. This bore terminates in the space between the pistons 3*a* and 3*b* so that, upon gas release, both pistons are driven apart. The electrical leads 12 extend through the cylinder chamber 2*b* to the compressed gas cartridge 8.

It is also possible, according to FIG. 2, to connect the individual cylinder chambers and pistons by long supply conduits for the gas and accommodate them in a spatially separated fashion. By the configuration of the supply lines for the gas, i.e., change in diameter and formation of ante-chambers it is furthermore possible to affect the chronological progression of the operation.

Figure 5:
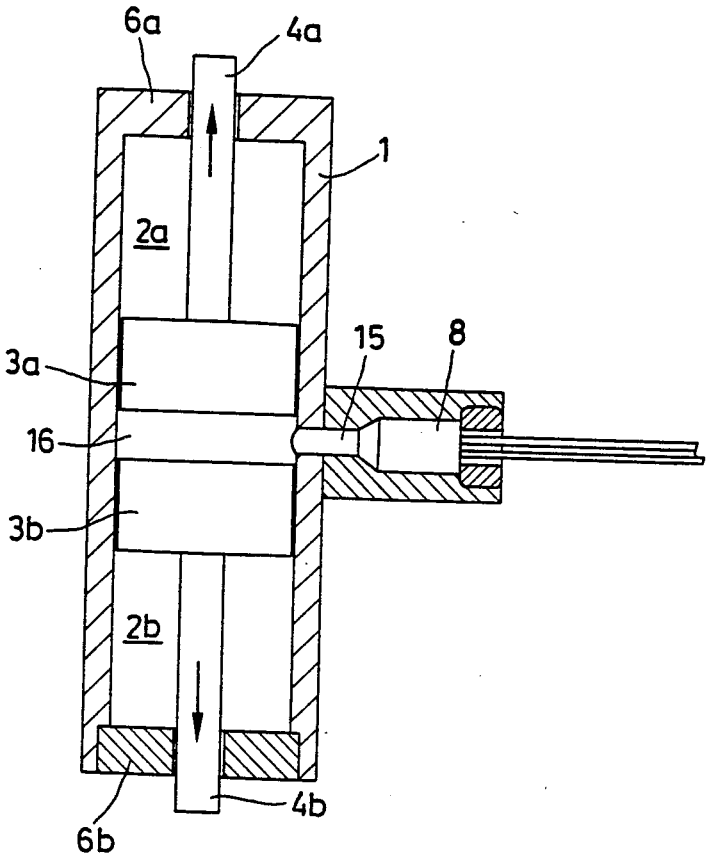
FIG. 5 is a longitudinal section through a fifth embodiment of the power element.

In the embodiment of FIG. 5, the housing 1 consists of an elongated cylinder containing two cylinder chambers 2*a* and 2*b* of equal cross section. The cylinder chambers 2*a* and 2*b* are arranged in series in the axial direction and pass over one into the other smoothly and without any shoulder. The piston 3*a* is displaceable in cylinder chamber 2*a*, and the piston 3*b* is displaceable in cylinder chamber 2*b*. In the rest position, both pistons 3*a* and 3*b* are located adjacent to each other and separated by an interspace 16, in the center of the cylinder. The duct 15 terminates into the interspace 16; this duct is supplied with compressed gas by the compressed gas cartridge 8 when the latter is triggered. The pin 4*a*, projecting from piston 3*a* as the piston rod, extends through an opening of the end wall 6*a* of the housing 1, which end wall delimits the cylinder chamber 2*a*, and the pin 4*b*, connected to piston 3*b* as the piston rod, leads through an opening of the end wall 6*b* of the housing 1, closing off the cylinder chamber 2*b*. While the end wall 6*a* is integrally formed with the housing 1, the end wall 6*b* consists of a plate with central aperture subsequently inserted in the cylindrical housing.

In case of triggering of the compressed gas cartridge 8, compressed gas flows into the interspace 16 and drives the pistons 3*a* and 3*b* apart whereby the pins 4*a* and 4*b* are ejected from the housing 1. Both pins 4*a* and 4*b* are arranged coaxially with respect to the housing 1.

That is claimed is:

1. A compressed gas-actuated mechanical power element comprising a housing containing a first cylinder chamber with a piston, displaceable in the first cylinder chamber, carrying a pin projecting from the housing and a compressed gas cartridge in communication with the first cylinder chamber; said housing further containing at least one second cylinder chamber, with a second piston displaceable therein and with a pin projecting from the housing; and both cylinder chambers being in communication with each other and in communication with the compressed gas cartridge.

2. A power element according to claim 1, wherein the pins of the pistons extend in parallel to each other.

3. A power element according to claim 1 wherein the first and second cylinder chambers are arranged in communication with the compressed gas cartridge by way of at least one duct.

4. A power element according to claim 2, wherein the first and second cylinder chambers are arranged in communication with the compressed gas cartridge by way of at least one duct.

5. A compressed gas-actuated power element comprising a housing containing a first cylinder chamber, a piston displaceable in the first cylinder chamber having a pin projecting from the housing and at least one second cylinder chamber, a second piston displaceable in said at least one second cylinder chamber having a pin projecting from the housing; a compressed gas cartridge in communication with the first cylinder chamber and said at least one second cylinder chamber; said compressed gas cartridge being arranged outside of the housing.

6. A power element according to claim 1, wherein the compressed gas cartridge is accommodated in one of the pistons.

7. A power element according to claim 2, wherein the compressed gas cartridge is accommodated in one of the pistons.

8. A power element according to claim 2, wherein the cylinder chambers are arranged along an axis common to both of them, in mutually opposed relationship.

9. A power element according to claim 6, wherein at least one of the pins is arranged eccentrically at the associated piston and extends through a bore in the other piston.

10. A power element according to claim 2, wherein the axes of the cylinder chambers are laterally offset with respect to each other, and the pins are arranged centrally at the pistons.

11. A power element according to claim 3, wherein the axes of the cylinder chambers are laterally offset with respect to each other, and the pins are arranged centrally at the pistons.

12. A power element according to claim 1, wherein the cylinder chambers are oriented into differing directions.

13. A power element according to claim 1, wherein the pins project from the pistons toward opposite directions and the compressed gas cartridge is in communication with an interspace between the pistons.

14. A power element according to claim 2, wherein the pins project from the pistons toward opposite directions and the compressed gas cartridge is in communication with an interspace between the pistons.

15. A power element according to claim 1, wherein the compressed gas cartridge contained within the housing is arranged within a partition wall located between the first cylinder chamber and the at least one second cylinder chamber.

16. A power element according to claim 1, wherein the compressed gas cartridge contained in the housing is in communication with a passage which communicates with the first cylinder chamber and with the at least one second cylinder chamber whereby gas discharged from the compressed gas cartridge is introduced into the first cylinder chamber and into the at least one second cylinder chamber via said passage.

* * * * *